US005988921A

United States Patent [19]

Medhin

[11] Patent Number: 5,988,921

[45] Date of Patent: Nov. 23, 1999

[54] PEN FOR LEFT HANDED WRITER

[76] Inventor: Michael S. Medhin, 2905 Willston Pl., Apt. 201, Falls Church, Va. 22044

[21] Appl. No.: 09/265,978

[22] Filed: Mar. 11, 1999

Related U.S. Application Data

[60] Provisional application No. 60/077,752, Mar. 12, 1998.

[51] Int. Cl.[6] ..... B43K 7/00

[52] U.S. Cl. ..... 401/209; 401/216

[58] Field of Search ..... 401/6, 209, 216

[56] References Cited

U.S. PATENT DOCUMENTS

| | | | |
|---|---|---|---|
| D. 168,227 | 11/1952 | Kather | 401/6 |
| 655,731 | 8/1900 | Pierce | 401/6 |
| 849,513 | 4/1907 | Sturm | 401/6 |
| 2,592,406 | 4/1952 | Faltin | 401/6 |
| 4,037,975 | 7/1977 | Huffman | 401/6 |
| 4,306,819 | 12/1981 | Schusseler | 401/6 |
| 4,355,915 | 10/1982 | Kaji et al. | 401/216 |

FOREIGN PATENT DOCUMENTS

| | | | |
|---|---|---|---|
| 1253384 | 1/1961 | France | 401/6 |
| 76799 | 10/1961 | France | 401/6 |
| 2488551 | 2/1982 | France | 401/6 |
| 93/01945 | 2/1993 | WIPO | 401/6 |

*Primary Examiner*—Charles R. Eloshway
*Attorney, Agent, or Firm*—Richard C. Litman

[57] ABSTRACT

A pen for left handed persons includes a writing tip having a cone including a bend proximate the socket for the ballpoint to form an angle in the cone. The pen resembles a standard tubular shaped body into which a tubular shaped ink cartridge, connected to the writing tip, is removably inserted. The tip protrudes from one end of the body but is dimensioned so that it does not interfere with placement of a standard pen cap thereon. The tip of the pen includes a tubular shank adapted to fit into an integral sleeve located at the writing end of the body. A second embodiment bends the body of the pen to achieve the desired angle, enabling the use of a standard removable pen tip.

1 Claim, 3 Drawing Sheets

PEN FOR LEFT HANDED WRITER

CROSS-REFERENCE TO RELATED APPLICATION

This application claims the benefit of U.S. Provisional Patent Application Ser. No. 60/077,752, filed Mar. 12, 1998.

BACKGROUND OF THE INVENTION

1. Field of the Invention

The present invention relates to writing utensils, particularly to pens that have the tip or the body of the pen angled for use by left handed writers.

2. Description of Related Art

Western written languages are read from left to right and written in the same direction. Thus, to write, a right handed writer pulls a writing utensil from left to right. However, a left handed writer must push a pen from left to right. Thus, the natural position of the pen in the left hand causes the pen to be inclined into the paper in the direction of writing and consequently aligns the pressure being exerted by the left hand against the paper with the direction of movement. This contrasts with a right-hander whose writing pressure is directed opposite the direction of movement across the page. These facts thus present a number of problems during left handed writing.

For example, as the pen is pushed, the left hand may be dragged across the face of the newly inked paper, causing it to smear. This is a function solely of the left-to-right direction of travel of the pen relative to the page. Thus, a left hander often compensates by forming a large arc with the left arm to bring the hand and pen from the left to rest to the right side of the writing, effectively writing from above the inked page. This contortion may become tiresome.

Moreover, the inclination of the pen against the paper, i.e. the left hand pushing the pen into the paper while holding the pen in the "natural" position, may cause the paper to rip, an occurrence which is far less likely when the pen is being pulled across the page by a right hander. Again, the left-hander compensates by contorting the left arm as described above. Therefore, a need exists for a pen which eliminates these problems and the consequential remedial actions by a left-hander.

Writing utensils with curved bodies and curved tips that orient the writing portion of the pen relative to the main body of the pen at an angle are known in the patent literature. For example, U.S. Pat. No. 3,352,621 issued to Hans Reinhard Fehling et al. on Nov. 14, 1967 discloses a writing instrument, with an internal tubular member that stores ink, which is angled a considerable distance from the ballpoint of the pen, which ballpoint is located at the tip of the tubular member. The tubular member is set at an angle from 30 to 50 degrees from an axis that concentrically passes through the tip of the pen. The internal tubular member and ball are not freely removable from the tubular housing within which they are placed. This presents manufacturing concerns and is inconsistent with the standard construction of ballpoint tip and hull constructed pens, for example, as commonly sold under the brandname BIC.

U.S. Pat. No. 5,172,994 issued to Robert Brown on Dec. 22, 1992 discloses a writing instrument that has grooves placed near the tip of the internal tubular member which stores the ink. The grooves are placed on only one side of the tubular member to enable the tubular member to be bent to an angle greater than 30 degrees from the axis that aligns with the tip of the pen.

U.S. Pat. No. 5,527,124 issued to Marjan Kolaric on Jun. 18, 1996 discloses a pen with a retractable flexible ink reservoir that is placed in a housing. The housing is bent at a considerable distance from the tip of the pen and an angle is formed with the axis that aligns with the tip of the pen as described above.

German Publication Number G 90 00 724.7 published on May 31, 1990 to Tiemann discloses a pen with an angled body relative to the tip. The angle of the body of the pen with the axis that aligns with the tip is about 45 degrees. The tip of the pen and connected ink cartridge are removable from the same end of the pen the cartridge is inserted. The housing or body of the pen is formed to fit the index and middle fingers of the scrivener in one embodiment with very small angles between the tip and body of the pen. A second drawing shows an enlarged body of the pen. A hump protrudes outward at the location of the angle formed on the pen, protruding in the opposite direction of the tip of the pen, for the purpose of resting an index finger. A second smaller hump on the same side of the pen as the writing tip and opposite the angled portion of the pen is provided as an area to fit a middle finger.

The distance from the tip of the pen to the angle formed is considerable with all the above named inventions. The large distance is not necessary and is cumbersome to the writing utensil. None of the above inventions disclose an body angled at above 50 degrees, either. The large body with its protrusions disclosed to fit the fingers of a scrivener and large angles are cumbersome and limit the use of the pen. The prior art does not teach a compact pen body that is angled with a removable ink cartridge, that permits present manufacturing methods to be simply adapted.

None of the above inventions and patents, taken either singly or in combination, is seen to describe the instant invention as claimed.

SUMMARY OF THE INVENTION

Accordingly, it is a principal object of the invention to provide a writing utensil having an angled writing tip, disposed very closely to the writing portion of the pen, thereby eliminating the need for altered tubular body structure as commercially available.

It is another object of the invention to vary the angle in the above tip to large angles which approach and simulate the normal writing angles of a right handed person.

It is another object of the invention to enable the ink cartridge with the above tip to be removable from a tubular body of the pen.

Still another object of the invention is to enable the ink cartridge and tip to be removable from a body that is angled.

It is an object of the invention to provide improved elements and arrangements thereof in an apparatus for the purposes described which is inexpensive, dependable and fully effective in accomplishing its intended purposes.

The present invention is a pen for left handed persons including a hollow body and a replaceable ballpoint tip which is angled very closely to the ball or writing portion of the pen. The angle formed between the axis that aligns with the point of the pen and the body of the pen nears 90 degrees, but is not limited thereto, in order to simulate the various normal angles of inclination of a pen held by a right handed person. In addition, the ink cartridge that is connected to the tip of the pen is removable, being inserted into the tubular body of the pen. Secondly, the removable ink cartridge and tip are combined with a body that is bent over a range approximating 90 degrees.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
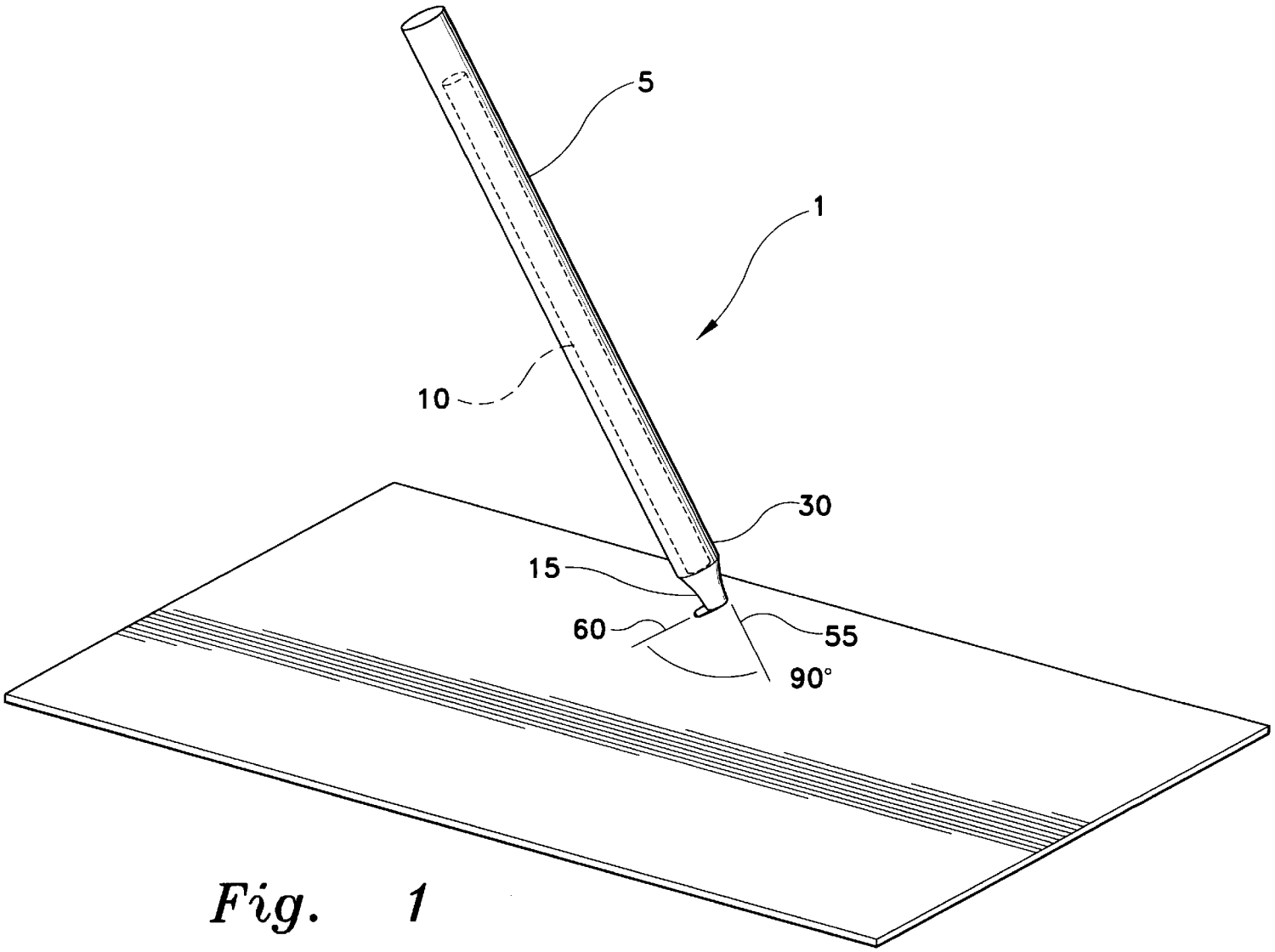
FIG. 1 is an environmental, perspective view of a pen for left handed persons according to the present invention.

The present invention is generally shown in FIG. 1 as providing a pen 1 for a left handed writer which includes several common components with a standard ballpoint pen. A tubular shaped body 5 is provided into which a tubular shaped ink cartridge 10 connected to a tip 15 is removably inserted. The tip 15 protrudes from one end of the body 5. The tip 15 of the pen includes a tubular shank 20 designed to fit into a tubular sleeve 30 located at the writing end of the body 5. However, to achieve its intended purposes, the present invention is described in two embodiments.

In the first embodiment, (FIG. 2) the tip 15 differs from a standard ballpoint tip. Common with other tips, it too includes a cone 25 with a socket 35 to hold the ball 40 of the pen. However, the critical design difference is that the cone 25 includes a bend immediately before the socket 35 to form an angle in the cone 25.

Unlike the first embodiment, the second embodiment (FIG. 3) includes a bend in the body 5 of the pen to achieve the desired angle while still enabling a common straight tip 50 joined to a flexible, tubular plastic ink cartridge 10 to be removed from the body 5. Owing to the nature of the flexible tubular ink cartridge 10, the tip 50 may be inserted into the body at the writing end while the cartridge 10 snakes through the angled portion.

Figure 2:
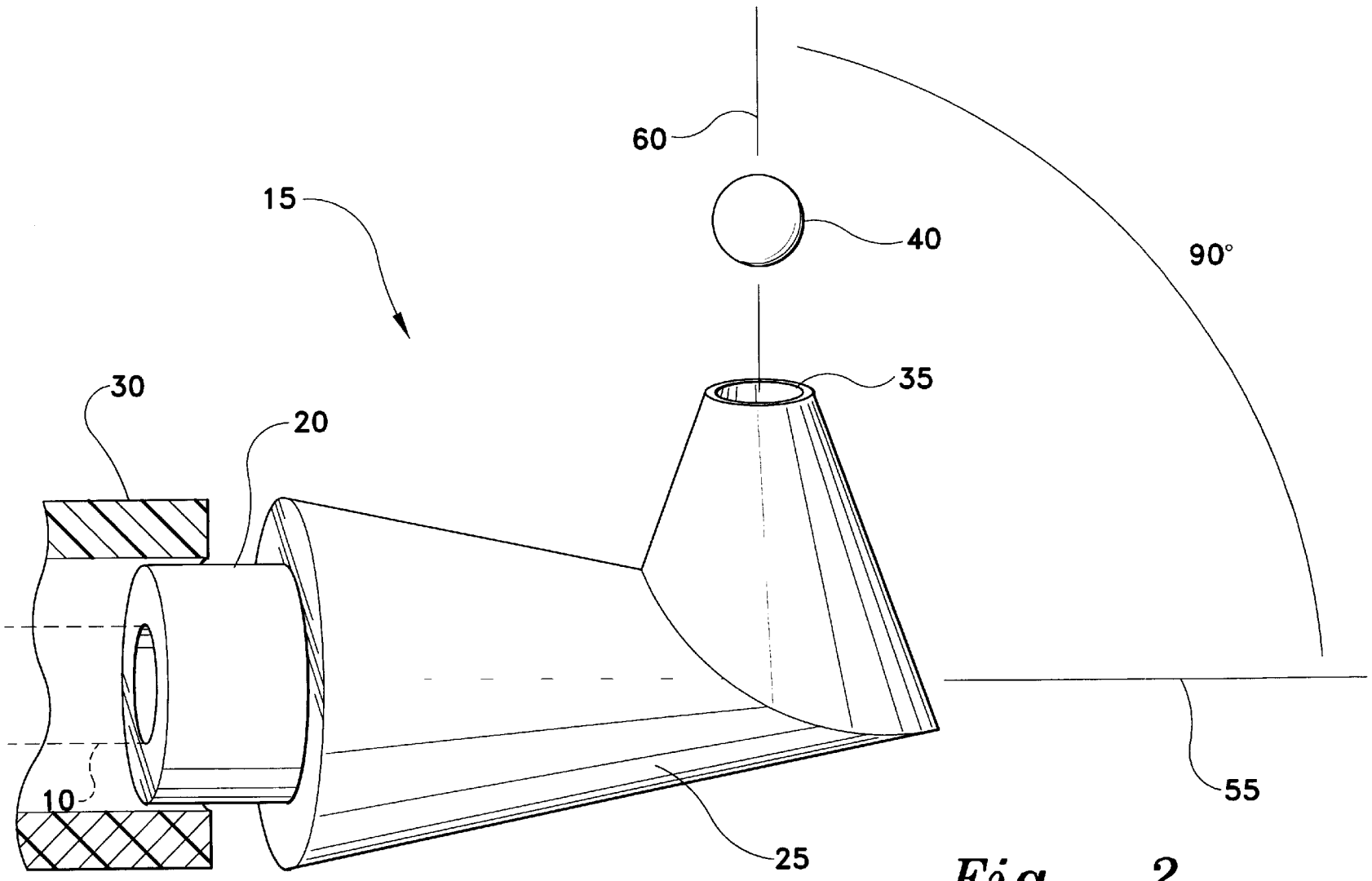
FIG. 2 is a greatly enlarged, exploded, perspective view of the removable portion of the tip of the pen with the cone angled at 90 degrees.

Referring back to the preferred embodiment of FIGS. 1 and 2, the body 5 of the pen is a straight shape about 6 inches long and a quarter inch in diameter. The body 5 of the pen is made from a rigid material, such as plastic. The body 5 defines a tube which allows a tubular ink cartridge 10 to be inserted therein. Each end of the tube is identical allowing the tubular ink cartridge 10 to be inserted into the body 5 from either end. For description purposes, the tubular sleeve 30 is defined as located at the end of the body 5 receiving the pen tip. The sleeve 30 is contiguous with the body 5. As best shown in FIG. 2, the sleeve 30 is constructed to enable another similarly tubular shaped object to fit snugly and to be held in place. The sleeve 30 and tip 15 also defines the end of the body 5 called the writing end or point end of the pen.

The tip 15 of the pen is constructed to fit into the sleeve 30. The tip 15 includes a tubular shank 20. The tubular shank 20 attaches to the cone 25 at base of the cone 25. The outer diameter of the shank 20 is slightly smaller than the inner diameter of the sleeve 30. The diameters of the shank 20 and the sleeve 30 are such that they fit snugly within each other and attach to one another. The ink cartridge 10 attaches to the shank 20. Thus, the tip 15 and ink cartridge 10 are removably attached to the body 5 of the pen. Therefore, a desired feature of the invention is that the tip 15 of the pen is removable from the body 5 of the pen to permit use with standard pen bodies.

The cone 25 part of the tip 15 is attached to the shank 20 as shown in FIG. 2. The hole in the shank 20 is in communication with a hole in the cone 25 forming an internal channel for the passage of the ink. A hole extends through the cone 25 and forms a socket 35 at the apex of the cone 25. The socket 35 holds the ball 40 of the pen, which is inked by the flow of ink through the channel to the socket 35. Ink evenly flows around the ball 40 and ink is transmitted to the writing surface when pressure is applied to the ball 40 of the pen. There are numerous commercially mechanisms to deliver ink to the tip 15 of a pen that enable the pen to write when pressure is applied. However, a removable ink cartridge 10 and the bent tip 15 as described herein are critical to the invention.

A ball 40 used in ball point pens today to deliver ink from the ink cartridge 10 to the writing surface is very small and, hence, the area that the ball 40 and socket 35 occupy is a very small portion of the tip 15. The tip 15 portion of a pen is relatively small also when compared to the body 5. Therefore, the cone 25 can be and is bent to form an angle, the angle formed between the axis 60 that concentrically passes through the ball and socket 35 and the axis 55 that longitudinally aligns with the body 5 of the pen. The bend in the cone 25 is close to the ball 40 and socket 35 joint, relative not only to the pen body, but also relative the tip itself. The short distance between the bend in the tip 15 and the point of the tip 15 that releases ink creates a very small bend area in the tip 15 of the pen such that a standard cap may be used to be put on the pen, wherein the pen cap does not interfere with the bend in the tip 15 of the pen.

The small bend in the pen makes the pen less cumbersome to use by a left handed writer and less distorted in appearance. Moreover, the short distance from the tip 15 of the pen to the point of the pen allows a scrivener to place his fingers close to the point of the pen also.

The bend in the tip 15 may be adapted to any writing utensil, not only pens that use ballpoints. Felt tip pens of varying degrees and pencils may benefit from bending the tip 15 very closely to the point of the pen as disclosed in the above embodiment.

The ink cartridge 10 is a tubular member that is used to store ink. The ink cartridge 10 may be made from a flexible material or from any suitable commercially available material that will store ink. The ink cartridge 10 stores ink supplied therefrom to the tip 15 of the pen. The diameter of outer surface of the ink cartridge 10 is smaller that the diameter of the inner tunnel through the shank 20. Thus, the ink cartridge 10 attaches to the shank 20 by fitting snugly into the shank 20. Ink flows through the continuous hollow tube in the tip 15 to the ball 40 of the pen.

The cone 25 of the tip 15 may be bent at many different angles and still serve its intended purpose. The angle formed between the axis aligned 55 with the body 5 of the pen and the axis aligned with the point 60 of the pen may vary from 0 degrees to 180 degrees. Large angles approximating 90 degrees are desirable with scriveners to enable the pen to flow forward versus being pushed forward.

A left hand scrivener moves his hand from left to right and pushes the point of the pen to the right and the rest of the pen follows behind the point. The movement of a pen relative the tip of the pen with a right hand scrivener is the opposite as that of a left hand scrivener. A right hand scrivener moves the body 5 of the pen to the right and the point follows behind the body 5. The body 5 of the pen moves to the right before or in front of the point of the pen with a right hand scrivener. The point follows behind the body 5 or the point flows behind the body as the right hand scrivener moves their hand from left to right. However, the left hand scrivener pushes the point of the pen before the body as his or her hand moves from left to right.

With an angle of greater than 90 degrees the point of the pen is shifted slightly behind the bend in the tip 15. The bend in the pen moves to the right before the point of the pen with a left hand scrivener when the pen is moved from left to right exactly as a right handed person would write. A large angle in the pen allows the point of the pen with a left handed scrivener to flow forward as it would with a right handed scrivener versus being pushed forward as it is usually with a left handed scrivener.

Figure 3:
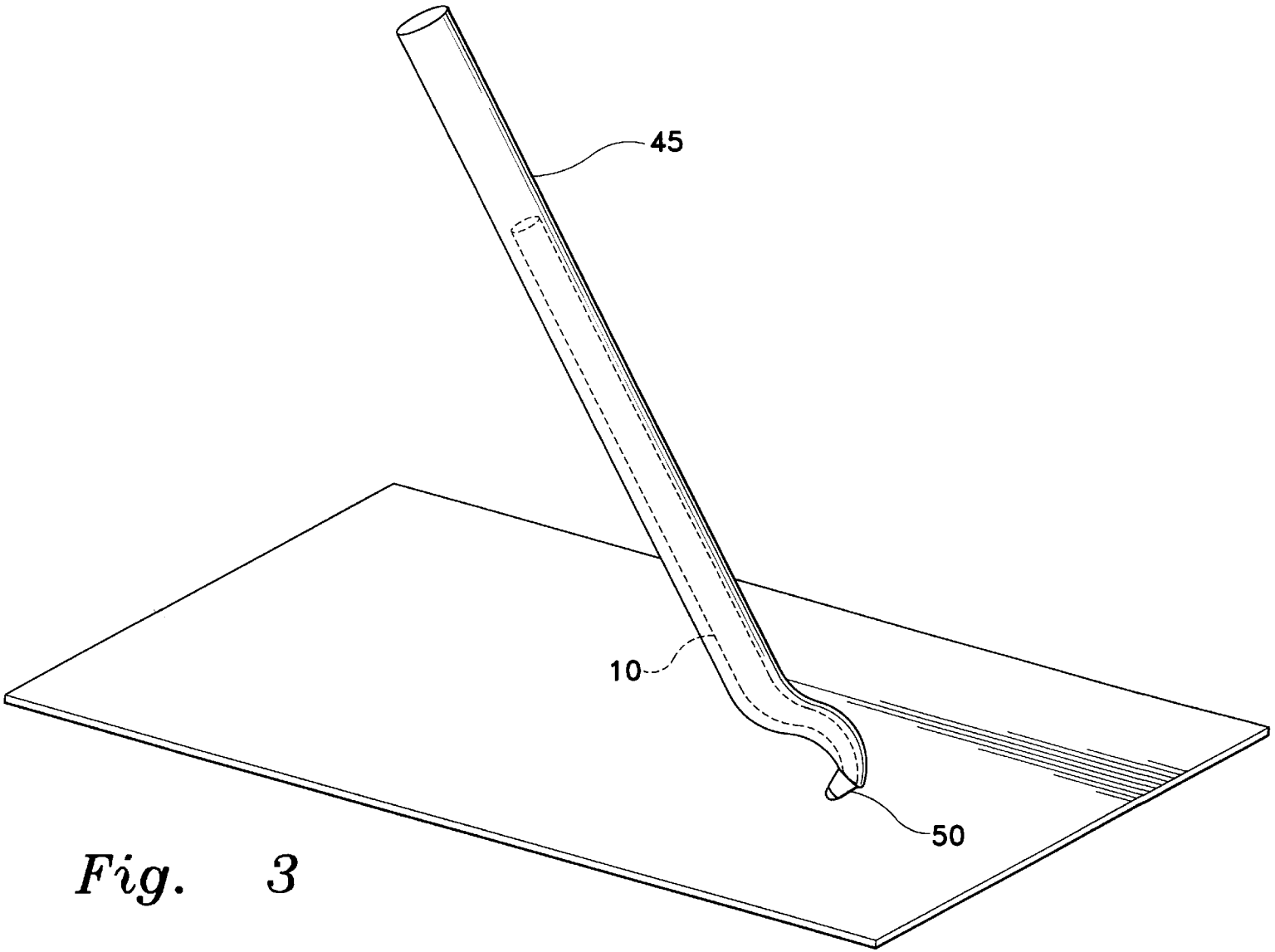
FIG. 3 is an environmental, perspective view of a pen with a bent tubular body.

Alternatively, the body 45 of the pen is bent as shown in FIG. 3. The body 45 of the pen includes a bend near the sleeve 30, a straight tip 50 is placed in the pen. The body 45 may be bent to many different angles. The angle formed between the axis 60 aligned with the point of the pen and the axis 55 aligned with the body 5 of the pen may vary, although a straight tip 50 continues to be used regardless of the angle at which the body 45 is bent to take advantage of prior manufacturing methods and the commercial availability of straight tips. Since the body 45 is bent there is no need to bend the tip 15 as in the preferred embodiment.

In summary, the critical design feature in the alternative embodiment combines the body 45 of the pen with a straight tip 50 and ink cartridge 10 that are removable from the body 45 that has been bent. A flexible ink cartridge 10 allows the ink cartridge 10 to maneuver through the body 45. The ink cartridge 10 may be slid into and out of the body 5 of the pen as described above even after the body 5 has been bent. The straight tip 50 snugly fits into the sleeve 30 at the end of the body 45 and is held in place as described above.

The pen of the present invention makes it possible for the person who writes with his or her left hand to do so with comfort and ease. The novel ergonomic design of the pen of the present invention eliminates the frustration experienced by a left handed writer using a conventional pen. Writing is now a pleasure and not a chore, and there is a dramatic improvement in the aesthetic appearance of the hand written material.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the sole embodiments described above, but encompasses any and all embodiments within the scope of the following claims.

I claim:

1. A pen for a left handed writer comprising:

a straight tubular body having an axis and integral tubular sleeve at one end thereof, a tubular ink cartridge disposed within said sleeve; and a removable writing tip in fluid communication with said ink cartridge, said writing tip including a cone having an axis, a base and an apex, said cone and said tubular body being coaxial, a tubular shank attached to said base, a socket having an axis and extending from said apex and a ball inserted in said socket, said shank being dimensioned to removably fit into said sleeve; wherein said socket extends from said apex of said come to form an angle between the socket and cone axes of about 90 degrees.

* * * * *

UNITED STATES PATENT AND TRADEMARK OFFICE

CERTIFICATE OF CORRECTION

PATENT NO. : 5,988,921
DATED : November 23, 1999
INVENTOR(S) : Charlton et al.

It is certified that error appears in the above-indentified patent and that said Letters Patent is hereby corrected as shown below:

Title page, item [75], line 1, delete the text "Allentown, N.J." and replace with Sunnyvale, CA--.

item [75], line 2, delete the word "Neal" and replace with -- Neil--.

item [75], line 2, delete "Lebanon" and replace with -- Newtown --.

In Claim 11, column 10, line 29, delete the phrase "which binds conjugate" and replace with -- which binds said conjugate --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*